United States Patent [19]

Michalik

[11] 4,380,449

[45] Apr. 19, 1983

[54] VARIABLE SIZE FOLDER CYLINDER

[75] Inventor: Horst B. Michalik, Hochberg, Fed. Rep. of Germany

[73] Assignee: Koenig & Bauer AG, Wurzburg, Fed. Rep. of Germany

[21] Appl. No.: 277,538

[22] Filed: Jun. 26, 1981

[30] Foreign Application Priority Data

Jul. 26, 1980 [DE] Fed. Rep. of Germany ..... 3028468

[51] Int. Cl.[3] ..... B65H 45/16

[52] U.S. Cl. ..... 493/424; 493/432

[58] Field of Search ..... 493/424–433

[56] References Cited

FOREIGN PATENT DOCUMENTS 930390 7/1949 Fed. Rep. of Germany ..... 493/428

565365 11/1944 United Kingdom ..... 493/432

*Primary Examiner*—A. J. Heinz

*Attorney, Agent, or Firm*—Jones, Tullar & Cooper

[57] ABSTRACT

A variable size folder cylinder for a web-fed rotary printing machine is disclosed. Spaced inner support wheels and spaced outer support wheels are carried by a common shaft. The inner and outer wheels serve as support for sheet grippers, folding blades and the like. The inner wheels and outer wheels are rotatable on the shaft with respect to each other so that the elements which they carry can be variably spaced about the periphery of the folder cylinder. A clutch assembly is carried by adjacent ones of these inner and outer support wheels with the clutch including a ring-shaped piston that carries a coupling ring which is brought into engagement with a thrust collar. A flexible membrane return ring is sealed between the ring-shaped piston and the face of the surrounding wall of the support wheel and acts to return the piston its rest position when actuating pressure is removed.

5 Claims, 3 Drawing Figures

VARIABLE SIZE FOLDER CYLINDER

FIELD OF THE INVENTION

The present invention is directed generally to a folder cylinder for use in a folder in a web-fed rotary printing machine. More particularly, the present invention is directed to a variable size folder cylinder having cooperating spaced wheel pairs. Most specifically, the present invention is directed to a variable size folder cylinder having a clutch assembly between the wheel pairs. The two pairs of wheels are cooperatively secured to a shaft and each wheel pair carries, for example, gripper elements or a folding blade. By actuation of the clutch assembly, the peripheral locations of the element carried by the first wheel pair can be varied with respect to the location of the element carried by the second wheel pair. The clutch assembly is carried by a wheel of the first pair and engages a wheel of the second pair. This clutch arrangement requires little space and is carried within the folder cylinder between the inner and outer wheel pairs.

DESCRIPTION OF THE PRIOR ART

Folder cylinders wherein the spacing of elements on the periphery of the cylinder may be varied are known generally in the art, as may be seen in German Pat. No. 1,561,073. In this patent the means supporting the gripper elements is capable of being spaced with respect to the means supporting the folding blades while the machine is in operation. This is accomplished by a clutch coupling which is provided for keeping both supporting means in a defined, spaced, peripheral position with respect to each other. The clutch in this patent acts directly on either support shaft one of which drives the support for the gripper elements and the other of which drives the support for the folding blades.

A disadvantage of this type of prior art clutch arrangement is that the clutch or clutches must be disposed exteriorly of the side frames of the folder and that the drive gears must therefore be spaced even further outside of the side frames of the folder. Since the clutch is positioned on the shaft extremities, it must also be dimensioned larger than necessary.

A clutch assembly which is positioned between the inner and outer supporting wheels of a folder cylinder is also known in the art, as may be seen in German Pat. No. 930,390. This clutch assembly is a screw which can only be loosened when the printing machine is at rest and does not provide a means for adjusting peripheral spacing of the elements on the folder cylinder while the printing machine is in operation.

SUMMARY OF THE INVENTION

It is an object of the present invention to provide a folder cylinder for a web-fed rotary printing press.

Another object of the present invention is to provide a variable size folder cylinder.

A further object of the present invention is to provide a clutch for adjusting the peripheral spacing of elements carried by the folder cylinder.

Yet another object of the present invention is to provide a clutch for a variable size folder cylinder in which the clutch is operable while the machine is in operation.

Still a further object of the present invention is to provide a clutch for a variable size folder cylinder in which the clutch is positioned between the inner and outer supporting wheels of the cylinder.

As will be discussed in greater detail in the description of a preferred embodiment as set forth hereinafter, the subject invention is comprised generally of a variable sized folder cylinder which carries inner and outer spaced wheel pairs, each of the wheel pairs acting as support for a peripherally carried element such as signature grippers, folding blades, or folding jaws. The inner and outer wheel pairs are rotatable with respect to each other so as to vary the peripheral spacing of the supported elements. A clutch assembly is carried by one of the inner wheels and cooperates with the adjacent outer wheel so that after the periheral spacing of the wheel pairs has been accomplished, the clutch can be actuated to maintain the desired spacing.

In contrast with prior known clutches and the like for use in varying the peripheral spacing of the elements carried by the folder cylinder, the clutch in accordance with the present invention is carried within the folder cylinder. It does not engage the shaft exteriorly of the cylinders or side frames and does not require a large amount of space. Thus a clutch of smaller size than those previously known in the prior art can be used. The clutch in accordance with the present invention also does not require that the printing machine be stopped before a adjustment of the peripheral spacing can be made. A further important feature of the clutch in accordance with the present invention is that it has a short coupling path and does not require a great deal of space. Furthermore, it separates well when being disengaged and separates in a full, complete and safe manner in spite of its small coupling path.

BRIEF DESCRIPTION OF THE DRAWINGS

While the novel features of the variable size folder cylinder in accordance with the subject invention are set forth with particularity in the appended claims, a full and complete understanding of the invention may be had by referring to the detailed description of a preferred embodiment as set forth hereinafter and as may be seen in the accompanying drawings in which:

DESCRIPTION OF A PREFERRED EMBODIMENT

Figure 1:
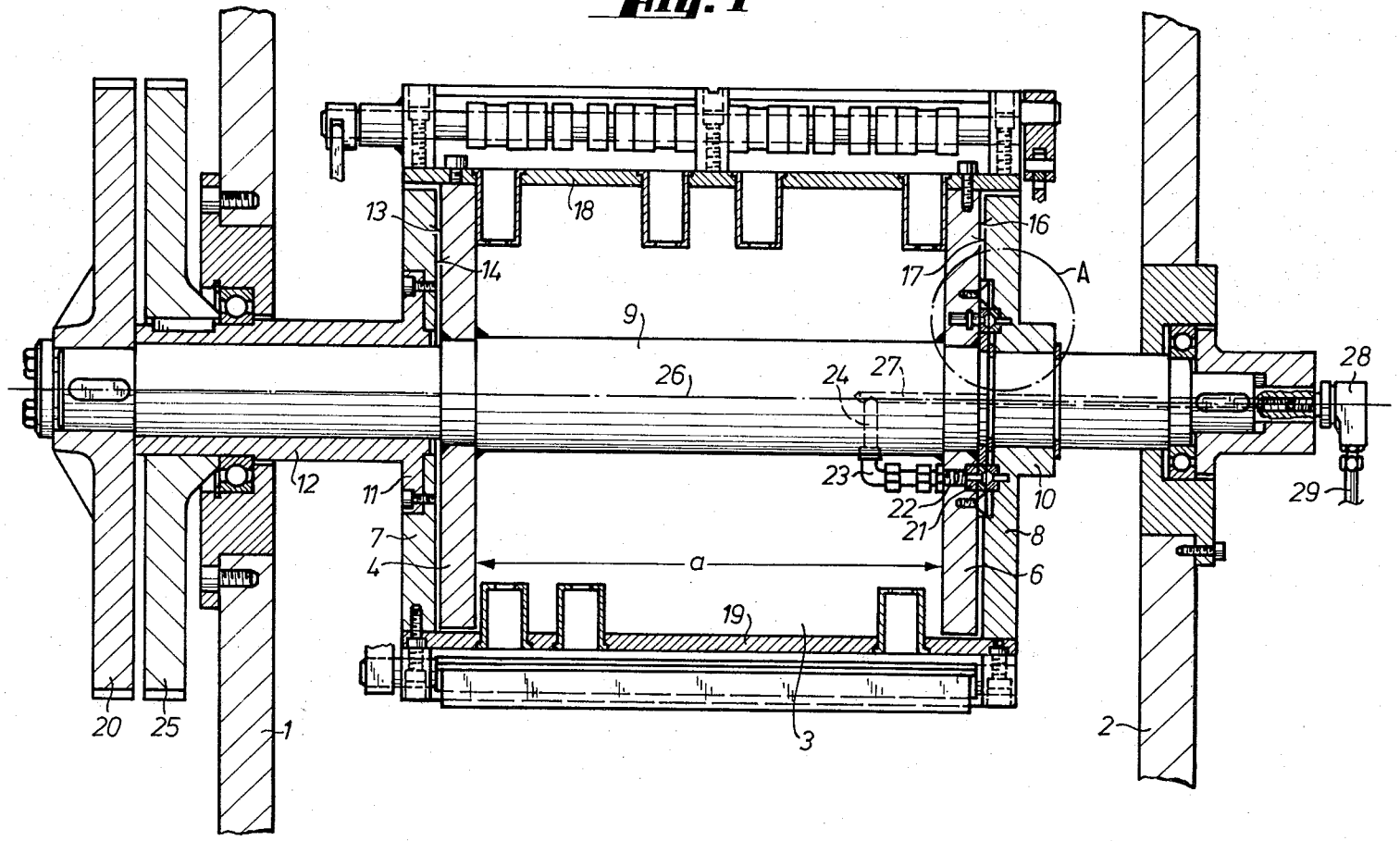
FIG. 1 is a side elevation view, partly in section, of a preferred embodiment of the variable size folder cylinder in accordance with the present invention.

Turning initially to FIG. 1, there may be seen a variable size folder cylinder, generally at 3, in accordance with the present invention. Folder cylinder 3 is disposed between side frames 1 and 2 of a conventional web-fed rotary printing machine. The folder cylinder 3 may be constructed as a cylinder equipped with pins or grippers and folding blades, or as a folding jaw cylinder. Folder cylinder 3 is comprised of a pair of spaced inner supporting wheels 4 and 6, and a pair of spaced outer supporting wheels 7 and 8. The inner supporting wheels 4 and 6 are perpendicularly welded onto a shaft 9 and are spaced at a distance "a" from each other. Shaft 9 is supported in the side frames 1, 2. A first outer supporting wheel 7 is perpendicularly screwed onto a flange 11 of a hub 12. Hub 12 is rotatably supported on the shaft 9. A second outer supporting wheel 8 is equipped with a hub portion 10, which is supported on the shaft 9. The inner supporting wheels 4, 6 and outer supporting wheels 7, 8 are positioned on shaft 9 so that side faces 13 and 14 of wheels 4 and 7 as well as side faces 16 and 17 of wheels 6 and 8 are spaced 2 mm from each other.

The pair of spaced inner supporting wheels 4 and 6 serve, for example, as supporting means for bars 18 which carry conventional pins or grippers, as is shown in the preferred embodiment, but they may also serve as supporting means for bars with folding jaws being, for example, not controllable. The pair of spaced outer supporting wheels 7 and 8 may serve as supporting means for bars 19, on which, for example, controllable folding jaws, controllable folding blades, as is shown in the drawing of the preferred embodiment, or not controllable folding jaws may be disposed.

The pair of spaced outer supporting wheels 7 and 8 are capable of being jointly rotated around the shaft 9 with respect to the spaced inner supporting wheels 4 and 6. The rotating motion of the outer supporting wheels 7 and 8 with respect to the inner supporting wheels 4, 6 is accomplished by means of gears 20, 25 which devices are known generally in the art, as described, for example, in the German Pat. No. 930,390. This movement of the outer wheel pair with respect to the inner wheel pair allows variations in the peripheral spacing of the elements carried by the outer wheel pair and the inner wheel pair so that the size of the folder cylinder is effectively varied.

Figure 2:
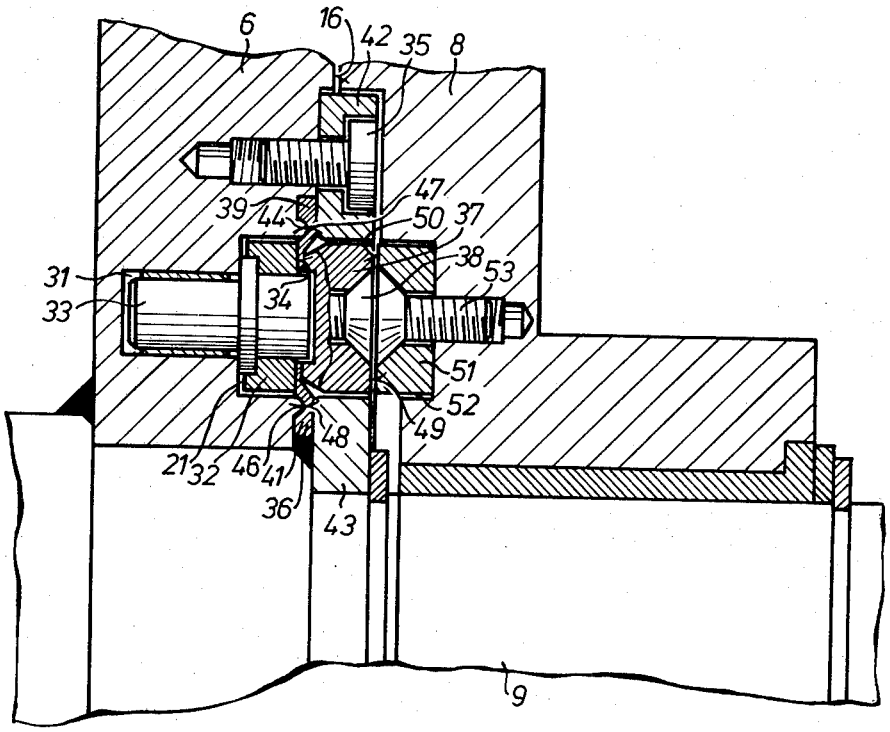
FIG. 2 is a side elevation view, partly in section of detail A of FIG. 1 and showing the clutch assembly of the variable sized folder cylinder in accordance with the present invention; and, FIG. 3 is an end view of the clutch assembly in accordance with the present invention with portions removed for clarity.
Figure 3:
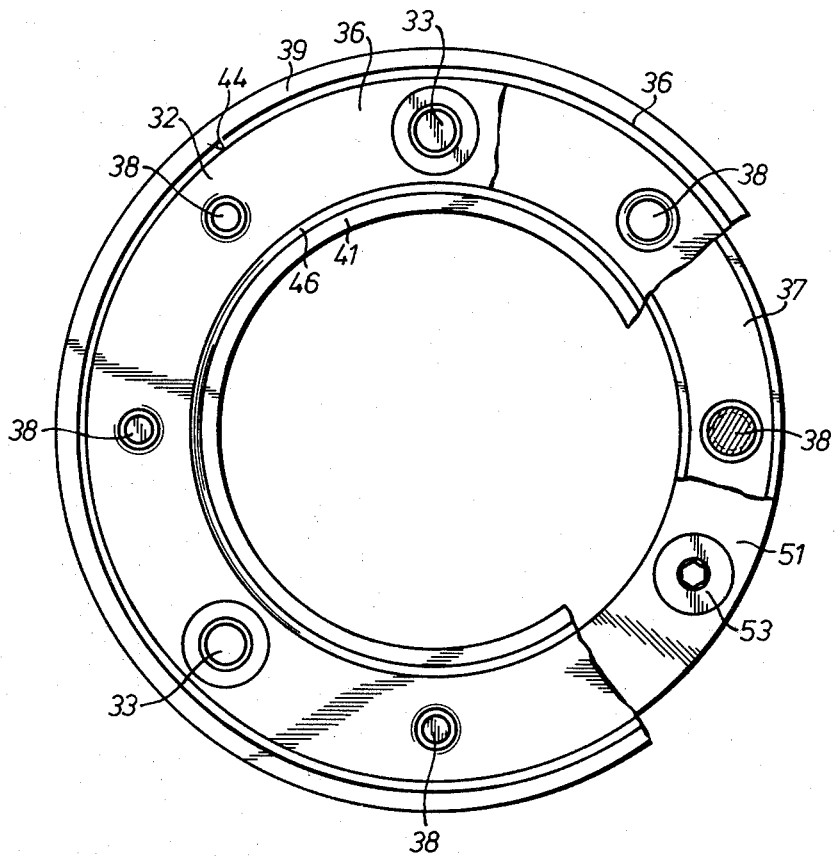

A coupling clutch is provided between at least one inner and one outer supporting wheel, for exaple, wheels 6 and 8, to permit keeping the inner and outer supporting wheels, 4, 6 and 7, 8 in a pre-selected position. In accordance with the present invention, this clutch is constructed as may be seen most clearly in FIG. 2. A space or recess 21 for a ring-shaped piston 32 is provided concentrically with the shaft 9 in the side face 16 of the inner supporting wheel 6. Space 21 for the ring-shaped piston 32 has a connection 22 with a tube 23, a perpendicular hole 24, and a horizontal hole 27, which extends eccentrically to an axis 26 of rotation of the shaft 9, all as shown in FIG. 1. A rotary connection 28 is connected with the hole 27, rotary connection 28 being joined by suitable hydraulic or pneumatic ducts 29 through a control valve with a controllable source of pressure, for example, a hydraulic pump or a compressor.

Referring again to FIG. 2, a plurality of guide holes 31 are provided in a base surface of the space 21 for the ring-shaped piston 32. The ring-shaped piston 32 is disposed in space 21, and is capable of being easily shifted. Movement of the ring-shaped piston 32, is guided by a pluraity of guide bolts 33, which are receivable in the guide holes 31. The guide bolts 33 slide easily in the guide holes 31, but prevent a rotary motion of the ring-shaped piston 32. A circular sealing return membrane ring 36 made of highly flexible plastic material, for example neoprene, is put onto a ring surface 34 of the ring-shaped piston 32, the ring surface 34 being positioned away from the space 21 for the ring-shaped piston 32. A coupling ring 37 is fixed on ring-shaped piston 32 by means of countresunk head bolts 38 and fastens the return membrane ring 36 to the ring-shaped piston 32, the return membrane ring 36 being placed between the ring-shaped piston 32 and the coupling rings 37. The width of the return membrane ring 36 is selected such that its outer rim portion 39 and its inner rim portion 41 project for approximately 8 mm on either side over the space 21 for the ring-shaped piston 32. The outer rim 39 of the return membrane ring 36 is clamped between an outer clamp ring 42 and the inner supporting wheel 6, with screws 35 being provided to secure outer clamp ring 42 onto the inner supporting wheel 6. The inner rim 41 of the return membrane ring 26 is clamped between an inner clamp ring 43 and the inner supporting wheel 6, screws (not shown) being provided to secure inner clamp ring 43 to the inner supporting wheel 6.

The outer rim 39 and the inner rim 41 of the membrane ring 36 are each equipped with a ring groove 44 and 46, respectively of semi-circular cross section. The inner supporting wheel 6 is formed with a semi-circular outer ring bead 47, and a similar inner ring bead 48; the outer ring groove 44 receiving the outer ring bead 47, and the inner ring groove 46 receiving the inner ring bead 48.

A layer of coarse-grained metallic oxide is applied onto an external coupling surface 49 of coupling ring 37 in order to increase its coefficient of friction. A friction surface portion 50 of a thrust collar 51 is the same size as the ring-shaped coupling surface 49. The thrust ring 51 is preferably made of a brass alloy and has a rectangular cross section which corresponds to that of a ring groove 52 provided in face 17 of the outer supporting wheel 8. The thrust ring 51 is secured in ring groove 52 by means of countersunk head bolts 53.

In operation, a pressure means, for example compressed air or hydraulic oil, to actuate the clutch is fed to space 21 for the ring-shaped piston 32 by means of a pivot valve (not shown) through duct 29, rotary connection 28, horizontal hole 27, perpendicular hole 24, and tube 23. This pressure causes the ring-shaped piston 32, the return membrane ring 36, and the coupling ring 37 to move in a direction toward the thrust collar 51 until the coupling surface 49 on piston 32 contacts the friction surface 50 of the thrust collar 51. Thus the outer supporting wheel 8 and the inner supporting wheel 6 are coupled to each other with the various elements carried at the peripheries of the spaced inner and outer wheel pairs accordingly being spaced peripherally from each other at a distance as desired by the specific application to which the folder cylinder is being placed.

When it becomes necessary to re-position the inner and outer support wheels with respect to each other, this is accomplished by shutting off the hydraulic or pneumatic pressure to the ring piston 32. The return membrane ring 36 then draws the piston 32 and coupling ring 37 away from the thrust ring 51 and back to their rest piston. Once the coupling ring 37 and thrust ring 51 have been separated, the inner and outer support rings 4, 6, and 7, 8, respectively can be rotated with respect to each other so that the peripheral spacing of the elements carried by these elements of the folder cylinder can be easily and quickly varied. The inner and outer support wheels can be placed quite close to each other because the coupling ring 37 requires only a space of 0.5 mm to move between the engaged and disengaged positions.

Thus it may be seen that a variable size folder in accordance with the present invention has been fully and completely set forth hereinabove. The folder cylinder's clutch arrangements allows quick, easy, and safe connection and disconnection of the inner and outer support wheels without requiring stoppage of the machine or waste of space. Although the preferred embodiment has been described, it will be obvious to one of skill in the art that a number of changes in, for example, the type of bearings used, the path for the actuating fluid, the types of element carried by the support wheels, and the like could be varied without departing from the true spirit and scope of the invention and that the invention is accordingly to be limited only by the following claims.

I claim:

1. A clutch assembly in combination with a folder cylinder of a folder for use in a web-fed rotary printing machine the folder cylinder having an inner pair of supporting wheels and an outer pair of supporting wheels, said inner and outer pairs of supporting wheels being axially spaced from each other on an axial support shaft and being capable of being rotatably displaced with respect to each other about said axial support shaft to permit variations in the spacing of devices carried by said inner and outer supporting wheels at the periphery of the folder cylinder, said clutch assembly being positioned between and acting on said outer and inner supporting wheels, said clutch assembly comprising:

An axially displaceable ring shaped piston positioned in a recess in a face portion of at least one of the inner supporting wheels;

a coupling ring secured on said ring shaped piston;

a return membrane ring clamped between said ring-shaped piston and said coupling ring, said return membrane ring projecting over said recess in said face portion of said inner supporting wheel, said return membrane ring having an outer rim and an inner rim to seal said recess for said ring-shaped piston, said outer rim and said inner rim of said return membrane ring being secured to said face of said inner supporting wheel;

a plurality of guide holes formed in said recess for said ring-shaped piston;

a plurality of guide bolts on a side of said ring-shaped piston facing said recess for said ring-shaped piston, said guide bolts engaging said guide holes;

means for supplying a pressurized fluid to said recess for said ring shaped piston; and a thrust collar carried by said outer supporting wheel and co-acting with said coupling ring whereby application of fluid pressure causes said coupling ring to engage said thrust collar to join said outer and inner supporting wheels together.

2. A clutch in accordance with claim 1, characterized in that said coupling ring is designed with a coupling surface having a high coefficient of friction.

3. A clutch in accordance with claim 2, characterized in that said thrust collar is made of a brass alloy.

4. A clutch in accordance with claim 1, characterized in that said return membrane ring is provided with an inner ring groove and an outer ring groove.

5. A clutch in accordance with claim 1, characterized in that said inner supporting wheel is provided with an inner ring bead and an outer ring bead.

* * * * *